US008692743B2

(12) United States Patent
Tsai et al.

(10) Patent No.: US 8,692,743 B2
(45) Date of Patent: Apr. 8, 2014

(54) PIXEL DRIVING CIRCUIT OF AN ORGANIC LIGHT EMITTING DIODE

(75) Inventors: Tsung-Ting Tsai, Hsin-Chu (TW); Chien-Ming Nieh, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 188 days.

(21) Appl. No.: 13/182,434

(22) Filed: Jul. 13, 2011

(65) Prior Publication Data

US 2012/0105421 A1 May 3, 2012

(30) Foreign Application Priority Data

Oct. 28, 2010 (TW) ..... 99136944 A

(51) Int. Cl.
*G09G 3/30* (2006.01)

(52) U.S. Cl.
USPC ..... 345/76

(58) Field of Classification Search
USPC ..... 345/45, 76, 77, 89, 204; 257/79, 82, 83, 257/84, 88; 349/139; 315/169.3
See application file for complete search history.

(56) References Cited

U.S. PATENT DOCUMENTS

| | | | | |
|---|---|---|---|---|
| 6,876,346 | B2 * | 4/2005 | Anzai et al. | 345/82 |
| 7,045,821 | B2 * | 5/2006 | Shih et al. | 257/79 |
| 7,382,342 | B2 | 6/2008 | Uchino et al. | |
| 7,414,600 | B2 | 8/2008 | Nathan | |
| 2003/0090446 | A1 * | 5/2003 | Tagawa et al. | 345/76 |
| 2004/0233148 | A1 | 11/2004 | Tanghe et al. | |
| 2007/0063932 | A1 | 3/2007 | Nathan et al. | |
| 2008/0001545 | A1 * | 1/2008 | Uchino et al. | 315/175 |
| 2008/0030436 | A1 * | 2/2008 | Iida et al. | 345/77 |
| 2008/0030446 | A1 * | 2/2008 | Asano | 345/87 |
| 2008/0231199 | A1 * | 9/2008 | Yamamoto et al. | 315/169.3 |
| 2010/0156762 | A1 * | 6/2010 | Choi | 345/76 |

FOREIGN PATENT DOCUMENTS

| | | |
|---|---|---|
| TW | 200901130 | 1/2009 |

* cited by examiner

*Primary Examiner* — Pegeman Karimi
(74) *Attorney, Agent, or Firm* — Winston Hsu; Scott Margo

(57) ABSTRACT

A pixel driving circuit of an organic light emitting diode (OLED) includes a first switch, a first capacitor, a transistor, a second switch, a second capacitor, and an OLED. The operation of the pixel driving circuit includes four stages of reset, threshold voltage compensation, data writing, and emitting. The pixel driving circuit compensates the threshold voltage of the transistor, so the driving current of the OLED is only related to the data voltage and the reference voltage.

5 Claims, 5 Drawing Sheets

PIXEL DRIVING CIRCUIT OF AN ORGANIC LIGHT EMITTING DIODE

BACKGROUND

1. Technical Field

The disclosure is related to a pixel driving circuit of an organic light emitting diode, and more particularly, to a pixel driving circuit of an organic light emitting diode for compensating a threshold voltage of a transistor.

2. Related Art

Please refer to FIG. 1. FIG. 1 is a diagram illustrating a conventional display panel utilizing organic light emitting diodes (OLED). The display panel 10 comprises a data driver 11, a scan driver 12 and a display matrix 13. The data driver 11 controls data lines $DL_1$ to $DL_n$, and the scan driver 12 controls scan lines $SL_1$ to $SL_m$. The data lines $DL_1$ to $DL_n$ and the scan lines $SL_1$ to $SL_m$ are interlaced to form the display matrix 13. Each interlaced data line and scan line forms one display unit. For instance, the data line $DL_1$ and the scan line $SL_1$ form the display unit 14. As shown in FIG. 1, an equivalent circuit of the display unit 14 (which is similar to other display units) comprises a switching transistor T11, a storing capacitor C11, a driving transistor T12 and an organic light emitting diode D11, where the switching transistor T11 and the driving transistor T12 are N-type transistors.

The scan driver 12 outputs scan signals to the scan lines $SL_1$ to $SL_m$ sequentially, so only the switching transistors corresponding to display units of a certain row of the scan driver 12 are turned on at one time, while switching transistors corresponding to display units of other rows are turned off. The data driver 11 outputs video signals (e.g. grey level values) to one row of display units via data lines $DL_1$ to $DL_n$, according to an image data to be displayed. For instance, when the scan driver 12 outputs the scan signal to the scan line $SL_1$, the switching transistor T11 of the display unit 14 is turned on, the data driver 11 transmits a corresponding pixel data to the display unit 14 via the data line $DL_1$, and a voltage of the pixel data is stored in the storing capacitor C11. The driving transistor T12 provides a driving current Ids to drive the organic light emitting diode D11 according to the voltage stored in the storing capacitor C11.

Since the organic light emitting diode D11 is a current driven component, the value of the driving current Ids determines a brightness of the light emitted by the organic light emitting diode D11. The driving current Ids, equivalent to a current flowing through the driving transistor T12, can be represented by formula (1):

$$Ids = \frac{1}{2}k(Vgs - Vth)^2 \tag{1}$$

where k represents a conducting parameter of the driving transistor T12, Vgs represents a voltage difference between a gate end and a source end of the driving transistor T12, and Vth represents a threshold voltage value of the driving transistor T12.

However, due to process variables of thin film transistors, electrical characteristics are varied for driving transistors in different regions of the display matrix 13, meaning threshold voltage values for the driving transistors are different. Therefore, when display units in different regions receive pixel data of the same voltage, values of the driving current provided to the organic light emitting diodes of the display units may be inconsistent, due to the threshold voltage difference between corresponding driving transistors. Consequently, varying brightness is generated by the organic light emitting diodes, causing the display panel 10 to display non-uniform images.

SUMMARY

The present invention discloses a pixel driving circuit. The pixel driving circuit comprises a first switch, a first capacitor, a transistor, a second switch and an organic light emitting diode. The first switch comprises a first end for receiving a data signal, a second end and a control end for receiving a scan signal. The first capacitor comprises a first end electrically connected to the second end of the first switch, and a second end. The transistor comprises a first end, a control end electrically connected to the first end of the first capacitor, and a second end electrically connected to the second end of the first capacitor. The second switch comprises a first end electrically connected to a first voltage source, a second end electrically connected to the first end of the transistor, and a control end for receiving a first control signal. The second capacitor comprises a first end electrically connected to the second end of the transistor, and a second end electrically connected to a second voltage source. The organic light emitting diode comprises a first end electrically connected to the second end of the transistor, and a second end electrically connected to the second voltage source.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
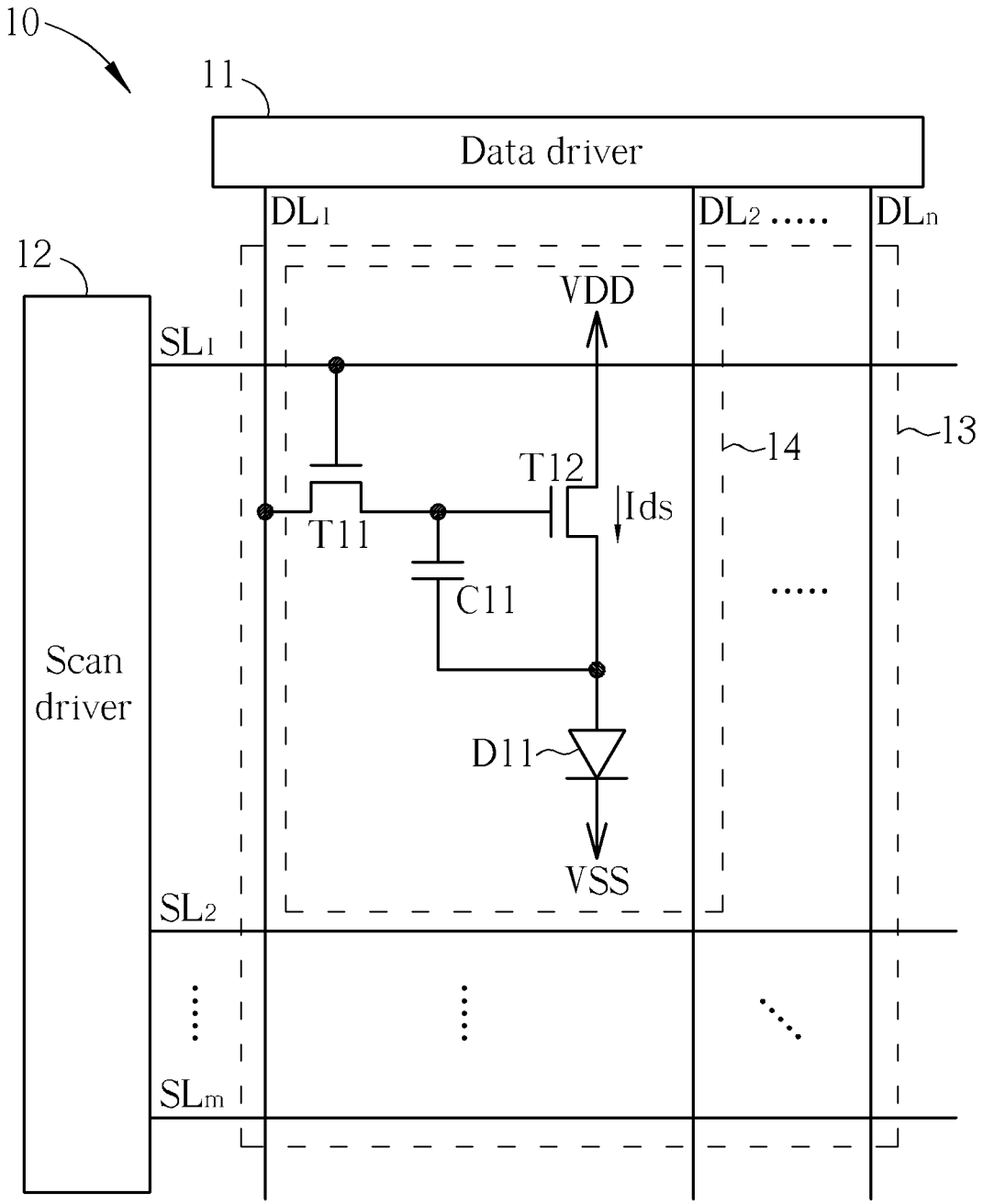
FIG. 1 PRIOR ART
FIG. 1 is a diagram illustrating a conventional display panel utilizing organic light emitting diodes (OLED).
Figure 2:
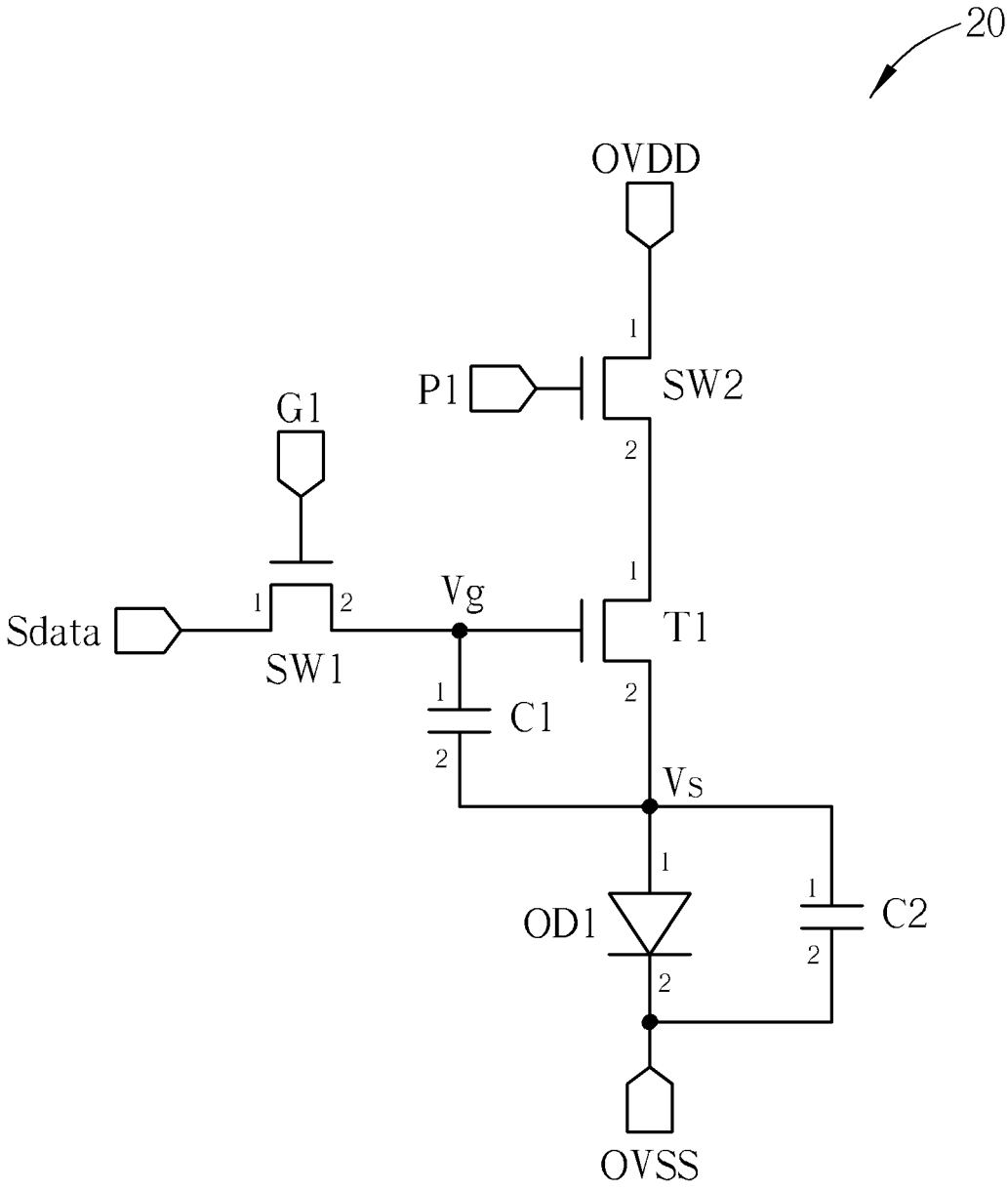
FIG. 2 is a diagram illustrating a pixel driving circuit of an organic light emitting diode according to a first embodiment of the present invention.

Please refer to FIG. 2. FIG. 2 is a diagram illustrating a pixel driving circuit of an organic light emitting diode according to a first embodiment of the present invention. The pixel driving circuit 20 comprises a first switch SW1, a first capacitor C1, a transistor T1, a second switch SW2, a second capacitor C2 and an organic light emitting diode OD1. A first end of the first switch SW1 receives a data signal Sdata and a control end of the first switch SW1 receives a scan signal G1. A first end of the first capacitor C1 is electrically connected to a second end of the first switch SW1. A control end of the transistor T1 is electrically connected to the first end of the first capacitor C1, and a second end of the transistor T1 is electrically connected to a second end of the first capacitor C1. A first end of the second switch SW2 is electrically connected to a first voltage source OVDD, a second end of the second switch SW2 is electrically connected to a first end of the transistor T1 and a control end of the second switch SW2 receives a first control signal P1. A first end of the second capacitor C2 is electrically connected to the second end of the transistor T1, and a second end of the second capacitor C2 is electrically connected to a second voltage source OVSS. A first end of the organic light emitting diode OD1 is electrically connected to the second end of the transistor T1, and a second end of the organic light emitting diode OD1 is electrically connected to the second voltage source OVSS. In the present embodiment, the first switch SW1, the second switch SW2 and the transistor T1 are N-type transistors. The first voltage source OVDD comprises a voltage with a high voltage level OVDDH and a voltage with a low voltage level OVDDL. A voltage Vs represents the voltage at the second end of the transistor T1, and a voltage Vg represents the voltage at the control end of the transistor T1.

Figure 3:
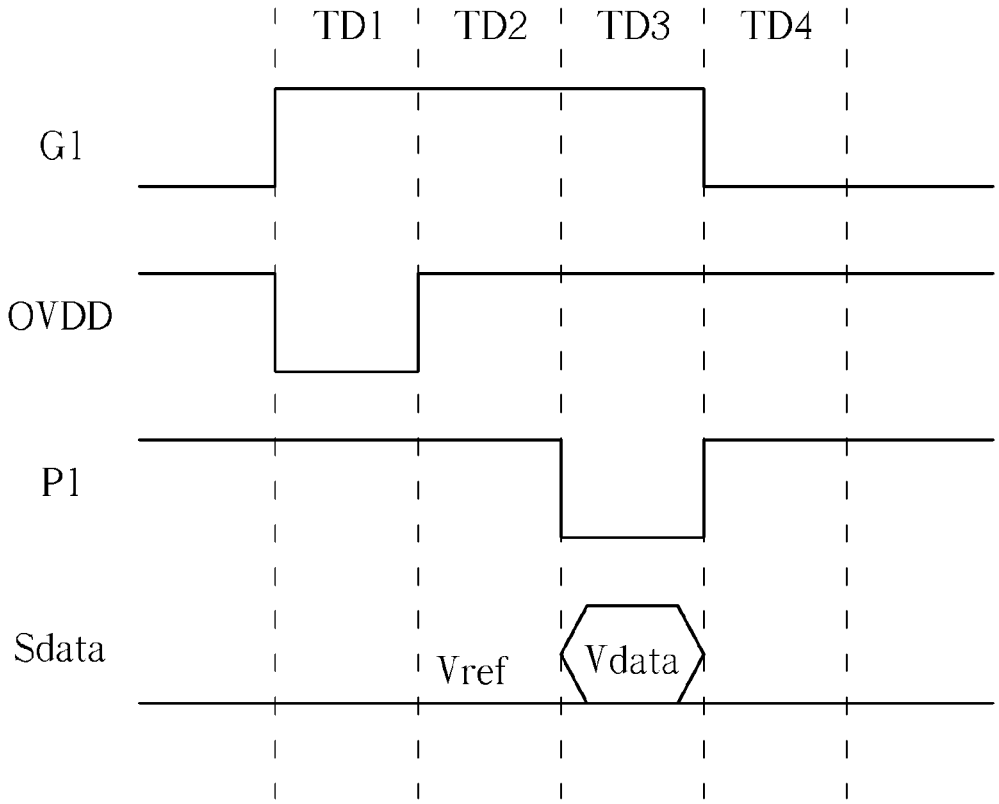
FIG. 3 is a diagram illustrating operating waveforms of the pixel driving circuit of FIG. 2.

Please refer to FIG. 3. FIG. 3 is a diagram illustrating operating waveforms of the pixel driving circuit of FIG. 2. The operation of the pixel driving circuit 20 mainly comprises four stages: reset, threshold voltage compensation, data writing, and light emitting. The first voltage source OVDD provides the voltage with the low voltage level OVDDL in the reset stage, and provides the voltage with the high voltage level OVDDH in other stages. The data signal Sdata provides a data voltage Vdata in the data writing stage, and provides a reference voltage Vref in other stages. The pixel driving circuit 20 performs reset in duration TD1 for setting the voltages Vg and Vs. In the duration TD1, the first voltage source OVDD provides the voltage with the low voltage level OVDDL, and the scan signal G1 and the first control P1 are logic high, so the first switch SW1 and the second switch SW2 are turned on, and the control end of the transistor T1 receives the reference voltage Vref. Since a voltage level of the reference voltage Vref is higher than the low voltage level OVDDL, the transistor T1 is also turned on and the second end of the transistor T1 receives the voltage with the low voltage level OVDDL. Therefore, the voltages Vg and Vs in the duration TD1 can be represented by formulae (1) and (2) respectively:

$$Vg=Vref \tag{1}$$

$$Vs=OVDDL \tag{2}$$

The pixel driving circuit 20 performs threshold voltage compensation in duration TD2. In the duration TD2, the first voltage source OVDD provides the voltage with the high voltage level OVDDH, and logic levels of the scan signal G1 and the control signal P1 remain unchanged, so the first and second switches SW1 and SW2 remain turned on. Since the first voltage source OVDD switches from outputting the voltage with the low voltage level OVDDL to outputting the voltage with the high voltage level OVDDH, and under the condition of the transistor T1 remaining turned on, a voltage difference between the control end and the second end of the transistor T1 has to be larger than a threshold voltage Vth of the transistor T1, so the voltage Vs is increased to Vref−Vth. Therefore, the voltages Vg and Vs in the duration TD2 can be represented by formulae (3) and (4) respectively:

$$Vg=Vref \tag{3}$$

$$Vs=Vref-Vth \tag{4}$$

The pixel driving circuit 20 performs data writing in duration TD3. In the duration TD3, the logic level of the scan signal G1 remains unchanged, and the control signal P1 is switched from logic high to logic low. This way, the first switch SW1 remains turned on, the second switch SW2 is turned off, and the data signal Sdata provides the data voltage Vdata to the control end of the transistor T1 via the first switch SW1. When the control end of the transistor T1 is switched from receiving the reference voltage Vref to the data voltage data Vdata, the second end of the transistor T1 generates a voltage difference ΔV due to a coupling effect of the capacitor C1, as shown in formula (5). Therefore, the voltages Vg and Vs in the duration TD3 can be represented by formulae (6) and (7) respectively:

$$\Delta V = \frac{C1}{C1+C2}(Vdata - Vref) \tag{5}$$

$$Vg = Vdata \tag{6}$$

$$Vs = Vref - Vth + \Delta V \tag{7}$$

The pixel driving circuit 20 performs light emitting in duration TD4. In the duration TD4, the scan signal G1 is switched from logic high to logic low, and the control signal P1 is switched from logic low to logic high. This way, the first switch SW1 is turned off and the second switch SW2 is turned on. The voltages Vg and Vs can then be represented by formulae (8) and (9) respectively:

$$Vg=Vdata+OVSS+VOLED-Vref+Vth-\Delta V \tag{8}$$

$$Vs=OVSS+VLED \tag{9}$$

where the voltage VOLED represents a voltage difference between the first and second ends of the organic light emitting diode OD1. A current $I_{OLED}$ which drives the organic light emitting diode OD1 is determined by the transistor T1, as shown by formula (10):

$$I_{OLED}=k(Vgs-Vth) \tag{10}$$

where the voltage Vgs represents a voltage difference between the control end and the second end of the transistor T1, and according to formulae (8) and (9), the voltage Vgs can be further represented by formula (11):

$$Vgs=Vdata-Vref+Vth-\Delta V \tag{11}$$

Therefore, according to formulae (5), (10) and (11), the current $I_{OLED}$ can be rewritten as formula (12):

$$I_{OLED} = k\left[\frac{C2}{C1+C2}(Vdata - Vref)\right]^2 \tag{12}$$

According to formula (12), the current $I_{OLED}$ which drives the organic light emitting diode OD1 is related only to the data voltage Vdata and the reference voltage Vref, mainly due to the pixel driving circuit 20 having compensated the threshold voltage Vth of the transistor T1.

Figure 4:
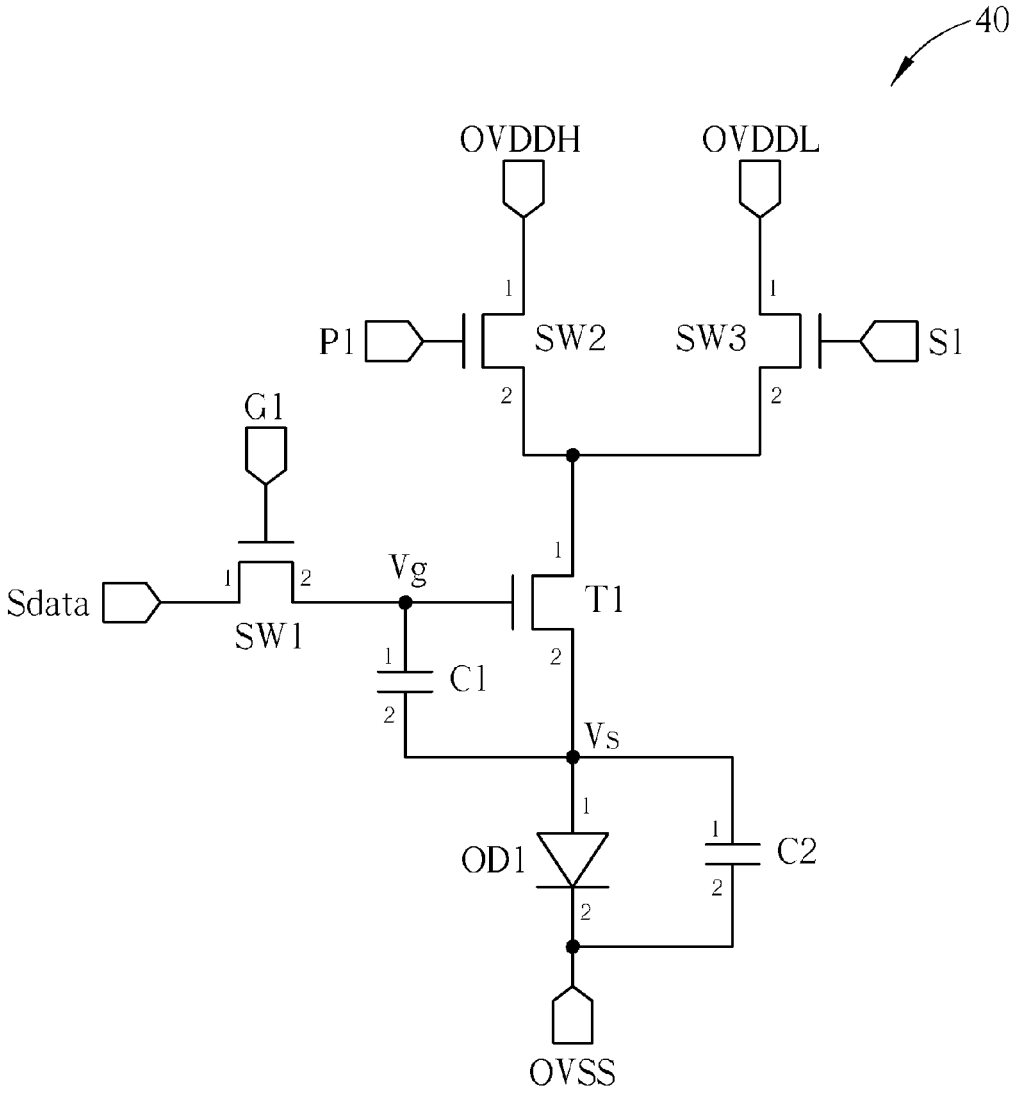
FIG. 4 is a diagram illustrating a pixel driving circuit of an organic light emitting diode according to a second embodiment of the present invention.

Please refer to FIG. 4. FIG. 4 is a diagram illustrating a pixel driving circuit of an organic light emitting diode according to a second embodiment of the present invention. In the first embodiment, the first voltage source OVDD of the pixel driving circuit 20 can provide voltages with the low voltage level OVDDL or the high voltage level OVDDH, meaning the first voltage source OVDD is an alternating current source. In the second embodiment, the pixel driving circuit 40 utilizes two direct voltage sources to replace the first voltage source OVDD, where the two direct voltage sources provide voltages with the low voltage level OVDDL or the high voltage level OVDDH respectively. The pixel driving circuit 40 further comprises a third switch SW3. The third switch SW3 is controlled by the control signal S1. The pixel driving circuit 40 can switch between the low voltage level OVDDL and the high voltage level OVDDH by utilizing the third switch SW3 and the first switch SW1 respectively.

Figure 5:
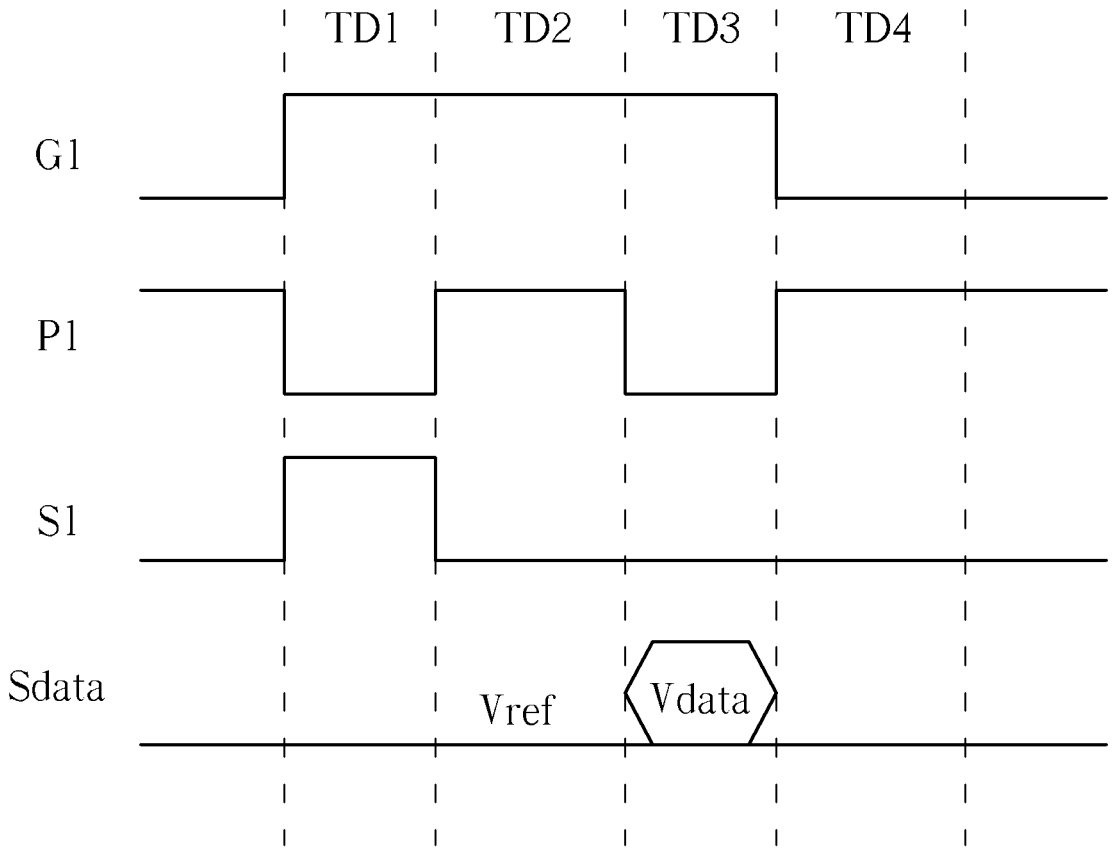
FIG. 5 is a diagram illustrating operating waveforms of the pixel driving circuit of FIG. 4.

Please refer to FIG. 5. FIG. 5 is a diagram illustrating operating waveforms of the pixel driving circuit of FIG. 4. The operation principle of the pixel driving circuit 40 is similar to the first embodiment, which comprises four stages: reset, threshold voltage compensation, data writing, and light emitting. In the first embodiment, the first voltage source OVDD provides the voltage with the low voltage level OVDDL in the reset stage, and provides the voltage with the high voltage level OVDDH in other stages. Hence, in the second embodiment, when the pixel driving circuit 40 performs reset in the duration TD1, the control signal P1 is logic low and the control signal S1 is logic high, so the second switch SW2 is turned off and the third switch SW3 is turned on, for the voltage with the low voltage level OVDDL to be transmitted to the transistor T1 via the third switch SW3. On the other hand, when the pixel driving circuit 40 performs threshold voltage compensation in the duration TD2 and performs light emitting in the duration TD4, the control signal P1 is logic high and the control signal S1 is logic low, so the second switch SW2 is turned on and the third switch Sw3 is turned off, for the voltage with the high voltage level OVDDH to be transmitted to the transistor T1 via the second switch SW2. Further, when the pixel driving circuit 40 performs data writing in the duration TD3, the control signals P1 and S1 are logic low, so the second and third switches SW2 and SW3 are turned off. This way, voltages Vg and Vs of the pixel driving circuit 40 in stages of reset, threshold voltage compensation, data writing, and light emitting are exactly the same as the first embodiment.

In summary, the pixel driving circuit of the organic light emitting diode comprises a first switch, a first capacitor, a transistor, a second switch, a second capacitor and an organic light emitting diode. The operation of the pixel driving circuit comprises four stages of reset, threshold voltage compensation, data writing, and light emitting. The pixel driving circuit can compensate inconsistent driving current caused by varying threshold voltages of the transistors. Therefore, brightness variation generated by the organic light emitting diodes can be reduced, preventing the display panel 10 from displaying non-uniform images.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel driving circuit, comprising:

a first switch, comprising a first end for receiving a data signal, a second end and a control end for receiving a scan signal;

a first capacitor, comprising a first end electrically connected to the second end of the first switch, and a second end;

a transistor, comprising a first end, a control end electrically connected to the first end of the first capacitor, and a second end electrically connected to the second end of the first capacitor;

a second switch, comprising a first end electrically connected to a first voltage source, a second end electrically connected to the first end of the transistor, and a control end for receiving a first control signal;

a second capacitor, comprising a first end electrically connected to the second end of the transistor, and a second end electrically connected to a second voltage source;

an organic light emitting diode, comprising a first end electrically connected to the second end of the transistor, and a second end electrically connected to the second voltage source; and a third switch, comprising a first end electrically connected to a third voltage source, a second end electrically connected to the first end of the transistor, and a control end for receiving a second control signal;

wherein the first voltage source is configured to supply a voltage of a first fixed voltage level, the third voltage source is configured to supply a voltage of a second fixed voltage level, and the first fixed voltage level is higher than the second fixed voltage level;

wherein when the first switch and the third switch are turned on and the second switch is turned off, the data signal transmits a reference voltage to the control end of the transistor via the first switch, and the second end of the transistor receives the voltage of the second fixed voltage level; and wherein when the first switch and the second switch are turned on and the third switch is turned off, the second end of the transistor receives the voltage of the first fixed voltage level, and a voltage of the second end of the transistor is generated according to the reference voltage and a threshold voltage of the transistor.

2. The pixel driving circuit of claim 1, wherein the first switch, the second switch and the transistor are N-type transistors.

3. The pixel driving circuit of claim 1, wherein when the first switch is turned on and the second switch and the third switch are turned off, the data signal transmits a data voltage to the control end of the transistor via the first switch.

4. The pixel driving circuit of claim 3, wherein when the first switch and the third switch are turned off and the second switch is turned on, the organic light emitting diode is driven according to a current generated by the data voltage and the reference voltage, and emits light.

5. A pixel driving circuit, comprising:

a first switch, comprising a first end for receiving a data signal, a second end and a control end for receiving a scan signal;

a first capacitor, comprising a first end electrically connected to the second end of the first switch, and a second end;

a transistor, comprising a first end, a control end electrically connected to the first end of the first capacitor, and a second end electrically connected to the second end of the first capacitor;

a second switch, comprising a first end electrically connected to a first voltage source, a second end electrically connected to the first end of the transistor, and a control end for receiving a first control signal;

a second capacitor, comprising a first end electrically connected to the second end of the transistor, and a second end electrically connected to a second voltage source;

an organic light emitting diode, comprising a first end electrically connected to the second end of the transistor, and a second end electrically connected to the second voltage source; and a third switch, comprising a first end electrically connected to a third voltage source, a second end electrically connected to the first end of the transistor, and a control end for receiving a second control signal;

wherein the first voltage source is configured to supply a voltage of a first fixed voltage level, the third voltage source is configured to supply a voltage of a second fixed voltage level, and the first fixed voltage level is higher than the second fixed voltage level;

wherein during a first duration, the scan signal and the second control signal are logic high, and the first control signal is logic low; during a second duration following the first duration, the scan signal and the first control signal are logic high, and the second control signal is logic low; during a third duration following the second duration, the scan signal is logic high, and the first control signal and the second control signal are logic low; and during a fourth duration following the third duration, the first control signal is logic high, and the scan signal and the second control signal are logic low; and wherein the data signal provides a reference voltage during the first duration, the second duration and the fourth duration, and the data signal provides a data voltage during the third duration.

* * * * *